United States Patent [19]

Ogata

[11] 4,348,934

[45] Sep. 14, 1982

[54] TUNING DEVICE FOR STRINGED MUSICAL INSTRUMENTS

[76] Inventor: Saburo Ogata, 2-11, Shonai Higashimachi 4-chome, Toyonaka-shi, Osaka 560, Japan

[21] Appl. No.: 198,956

[22] PCT Filed: Oct. 31, 1978

[86] PCT No.: PCT/JP78/00016

§ 371 Date: Jun. 25, 1980

§ 102(e) Date: Jun. 25, 1980

[87] PCT Pub. No.: WO80/01013

PCT Pub. Date: May 15, 1980

[51] Int. Cl.[3] ..... G10D 3/14

[52] U.S. Cl. ..... 84/306; 84/297 R; 84/312 R

[58] Field of Search ..... 84/201, 204, 297 R, 84/304–306, 312 R

[56] References Cited

U.S. PATENT DOCUMENTS

| | | | |
|---|---|---|---|
| 69,259 | 9/1867 | Seehausen | 84/306 |
| 1,363,902 | 12/1920 | Muller | 84/297 R |
| 2,453,572 | 11/1948 | Ferrier | 84/304 X |
| 3,403,588 | 10/1968 | Downing | 84/306 |
| 3,695,137 | 10/1972 | Eurich | 84/312 |
| 3,834,266 | 9/1974 | Robinson | 84/297 R |

*Primary Examiner*—Lawrence R. Franklin

*Attorney, Agent, or Firm*—Schwartz, Jeffery, Schwaab, Mack, Blumenthal & Koch

[57] ABSTRACT

The invention relates to a device for tuning a stringed musical instrument by a simplified procedure.

Every time stringed instruments are to be played, all the strings, which are loosened while not in use, must usually be tuned one by one. This imposes a heavy burden on the player. The invention provides a device by which strings in an initially tuned state can be loosened all at the same time by a single action and can thereafter be restored to the previous tuned tensioned state at the same time for use.

The device comprises a movable support (4) carrying string winding assemblies (5) and reciprocally movably supported by the head (10) of a stringed instrument, and a reciprocating assembly (6) for forcibly moving the support (4) to loosen the strings from a tuned state or tension the strings to the original state all at the same time.

To assure greatly improved performance, the tuning device of the invention is further equipped with means for reliably holding string ends to string winding pins, an assembly for visually tuning the strings, and an assembly for holding the strings under tension. The invention can be embodied for stringed instruments having strings for producing tones, such as guitars, mandolins, contrabasses, violins, violas, cellos, etc.

5 Claims, 13 Drawing Figures

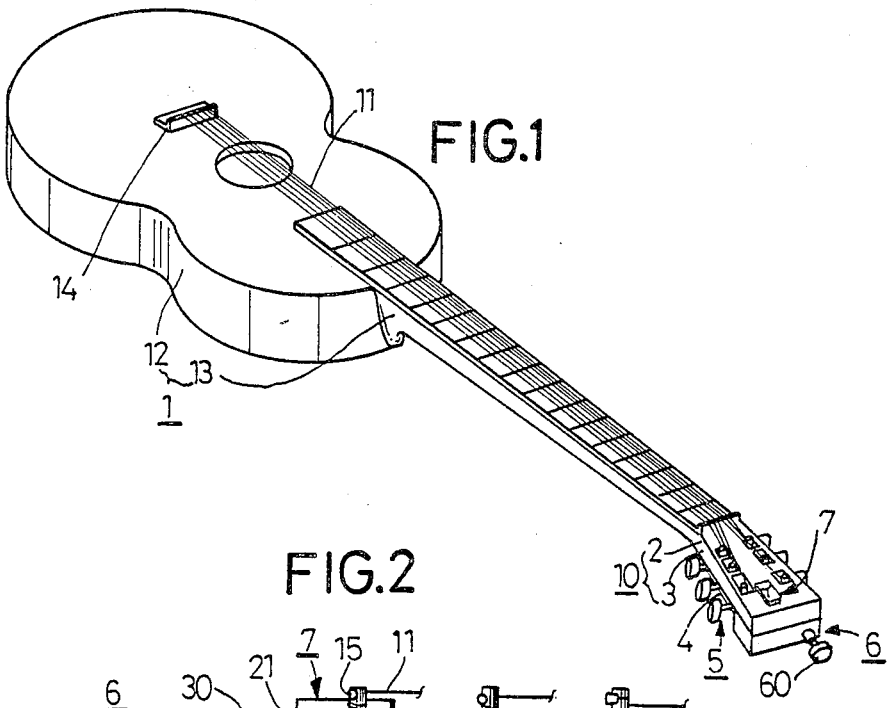
FIG.1
FIG.2
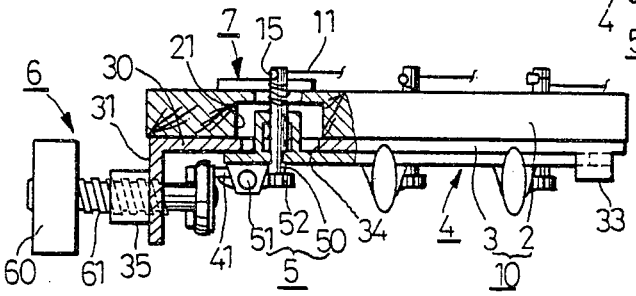
FIG.3
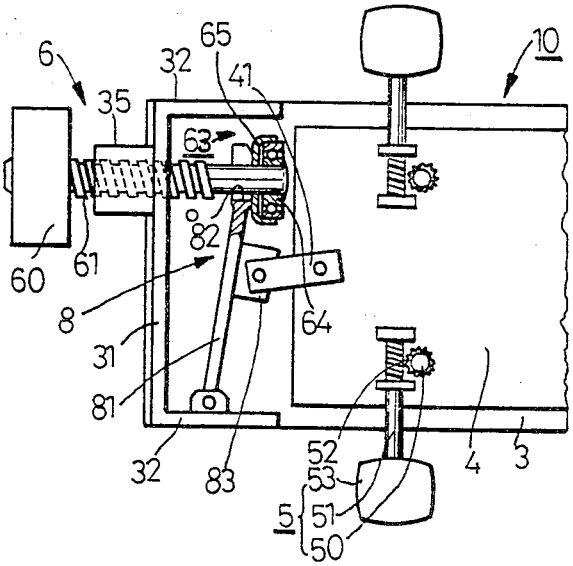

TUNING DEVICE FOR STRINGED MUSICAL INSTRUMENTS

TECHNICAL FIELD

This invention relates to a tuning device which is adapted for use in guitars, violins and other stringed musical instruments having strings for producing tones and by which all the strings in a tuned state can be loosened at the same time and can thereafter be returned to the original tuned tensioned state at the same time. More particularly in connection with the tuning device, the invention relates to means for reliably holding the string to a string winding assembly, an assembly for indicating the degree of tension of the strings and an assembly for holding all the strings tensioned.

BACKGROUND ART

The strings of a stringed musical instrument are provided on the frame of the instrument all under fairly high tension. If the instrument is allowed to stand with the strings held tensioned, various objections could result. For example, the strings would be elongated or broken due to fatigue, or the members holding the strings under tension would be deformed or damaged. Accordingly it is desirable to loosen all the strings after playing, but if loosened, the strings must be tensioned and tuned one by one with use of a pitch pipe or the like before playing the instrument. The tuning procedure requires much labor and is very cumbersome especially for beginners.

DISCLOSURE OF INVENTION

According to the present invention, the head 10 of a stringed instrument is provided with a movable support 4 which is reciprocally movable along the strings and which is equipped with string winding assemblies 5 for the strings. The movable support 4 is forcibly shiftable back and forth by a reciprocating assembly 6, whereby the strings can be loosened all at the same time after tuning or can be returned to the original tuned state under tension at the same time. This serves to eliminate the tuning procedure conventionally needed every time the instrument is to be played, greatly alleviating the burden on the player.

Further according to the invention, a holder 15 is attached to one end of each string, and the holder 15 is engaged in a holding portion 55 formed in an insertion bore 54 of a string winding pin 50 to reliably hold the string end to the pin 50. While the string is liable to slip on or disengage from the winding pin 50, such an objection can be completely avoided to reduce the necessity of tuning and assure the advantages of the invention.

Further according to the invention, there is provided an assembly 7 for indicating the shift of the movable support 4 on a scale with an indicator 70 which is shiftable with the travel of the movable support 4 so that the instrument can be tuned visually while watching the indicating assembly 7 instead of resorting to the hearing sense conventionally used for tuning. Thus the instrument can be tuned more easily, rapidly and accurately.

Further according to the invention, the device is provided with means 9 for restraining the return of the movable support 4 due to the tension of the strings to completely prevent all the strings from loosening at the same time and thereby enable the device to exhibit improved performance.

BRIEF DESCRIPTION OF THE DRAWINGS

FIG. 1 is a perspective view showing a folk guitar equipped with a tuning device of this invention;

FIG. 2 is a front view partly broken away and showing the construction of a head;

FIG. 3 is a view showing the construction of the head as it is seen from therebelow;

BEST MODE OF CARRYING OUT THE INVENTION

Figure 4:
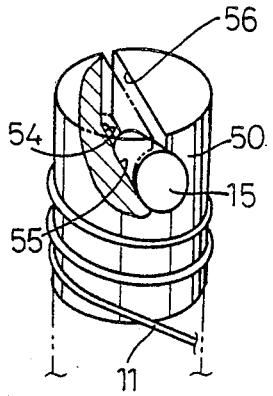
FIG. 4 is a perspective view partly broken away and showing a winding pin with a string held thereto.

The present invention can be embodied for various stringed instruments having strings for producing tones, for example, for stringed instruments, such as guitars, mandolins, harps and contrabasses, in which the strings are plucked to yield tones, and for violins, violas, violoncellos and like instruments in which tones are produced by the friction of a bow with the strings.

The drawings show embodiments of the invention for guitars, more particularly for folk guitars and classic guitars. These embodiments will be described in detail with reference to the drawings.

FIG. 1 to FIG. 3 show a tuning device embodying the invention for a folk guitar and provided on a head base 2 integral with the frame 1 of the guitar. The frame 1 comprises a body 12 and a neck 13 extending from the body 12 longitudinally thereof. Each of six strings 11 provided on the instrument 1 has one end attached to a holding plate 14 on the upper side of the body 12 and the other end wound around a winding assembly 5 mounted on a head 10 at the forward end of the neck 13. The head 10 comprises the base 2 projecting from the forward end of the neck 13 and a fixed support 3 fitted to the under side of the base 2 and secured to the base 2 at suitable peripheral portions with screws. The fixed support 3 supports beneath its under side a movable support 4 reciprocally movable along the strings 11.

The base 2 is formed in its under side with three cavities 21 along each of its lateral opposite sides in symmetrical arrangement, the cavities further extending through the base 2. Each of the cavities 21 has accommodated therein the winding assembly 5 for the string 11. The fixed support 3 comprises a horizontal base plate 30 having a front wall 31 extending downward from its front end and opposite side walls 32, 32.

Flanges 33, 33 for slidably supporting an end portion of the movable support 4 project from the rear end of the base plate 30 on opposite sides of its under surface. The base plate 30 has apertures 34 positioned in corresponding relation to the cavities 21 of the base 2. The winding assemblies 5 for the strings 11 project through the apertures 34 into the cavities 21.

In corresponding relation to the apertures 34 of the fixed support 3, the winding assemblies 5 for the strings 11 are mounted on the movable support 4 which is made of metal plate.

The winding assembly 5 comprises a string winding pin 50 and a peg 51 intersecting eacn other at right angles and coupled together by a worm gear 52. The pin 50 and the peg 51 are turned by a knob 53 to wind the string end on the forward end of the pin 50. With folk guitars, the winding pin 50 is supported vertically on the movable support 4 with its upper end projecting upward beyond the base 2, while the peg 51 is supported horizontally on the under surface of the movable support 4 with the knob 53 projecting sidewise from the movable support 4.

Since the movable support 4 is reciprocally movable relative to the fixed support 3, the cavities 21 in the base 2 and the apertures 34 in the fixed support 3 preferably have an elongated shape permitting the reciprocal movement of the winding assemblies 5.

Figure 5:
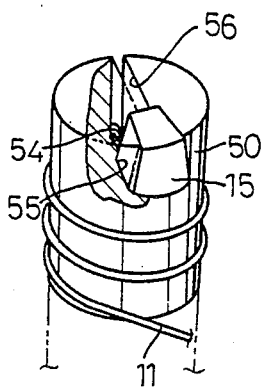
FIG. 5 is a perspective view partly broken away and showing another embodiment for holding the string to the winding pin.

While the string is liable to slip on or dislodge from conventional string winding pins, such trouble can be completely eliminated by the structures shown in FIG. 4 and FIG. 5. With reference to these drawings, the winding pin 50 has a string insertion bore 54 extending diametrically therethrough and a holding portion 55 provided by enlarging one open end of the bore 54. A groove 56 for engaging in the string is formed in the end face of the pin 50 in communication with the insertion bore 54. The string is placed into the bore 54 through the groove 56 with the string end attached to a holder 15, and the holder 15 is engaged in the holding portion 55. The string is thus held to pin 50 and wound around the pin.

The holder 15 is tapered in the form of a cone or pyramid. When it is made from synthetic resin, the string end is embedded in the holder 15 as bent to a U-shape to attach the string 11 to the holder 15.

Figure 6:
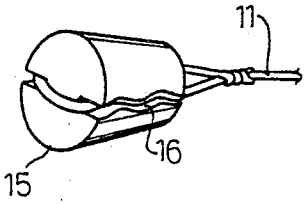
FIG. 6 is a perspective view showing a holder with a string end attached thereto.

FIG. 6 shows another example of the holder 15 which is made of metal. The holder 15 is formed at its opposite sides with axial wavy cutout grooves 16 and 16. With one end of the string 11 engaged in the grooves 16, the holder 15 is pressed to close the groove openings and hold the string end in place. The holding portion 55 in the pin 50 is of course shaped in conformity with the shape of the holder 15. The holder 15 is not limited to the conical form shown in FIG. 4 or to the pyramidal form shown in FIG. 5 but can be of any desired form.

A reciprocating assembly 6 is provided between the fixed support 3 and the movable support 4 for forcibly shifting the movable support 4. An internally threaded sleeve 35 is attached to the front wall 31 of the fixed support 3. A handle stem 61 having a handle 60 at its base end extends through the sleeve 35 in screw-thread engagement therewith. The forward end of the handle stem 61 projecting inside the front wall 31 is coupled to an edge of the movable support 4 by a force doubling mechanism 8 and a connector 41. Thus the movable support 4 is reciprocally movable by turning the handle 60. The force increasing mechanism 8 used for the present embodiment includes a lever 81 having a base end pivotally supported on the inner surface of one side wall 32 and a forward end provided with a groove opening 82, in which the handle stem 61 is engaged. The lever 81 is supported by a support member 63 mounted on the forward end of the handle stem 61 and is reciprocally movable with the stem 61. In the illustrated embodiment, a ball bearing is used as the support member 63. The handle stem 61 is attached to the inner race 64 of the bearing, while the lever 81 is supported by the outer race 65 thereof. The inner race 64 alone is rotatable with the handle stem 61.

A connecting piece 83 projecting from the lever 81 approximately from the middle of its length is pivoted to the connector 41 extending from the movable support 4, whereby the external force applied to the forward end of the lever 81 is approximately doubled by the action of the lever and given to the connector 41.

Figure 12:
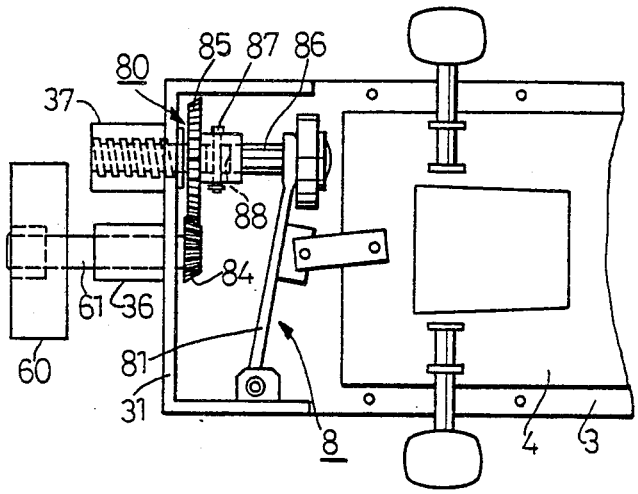
FIG. 12 is a view illustrating the construction of a head including a force doubling mechanism as the head is seen from below.

FIG. 12 shows an embodiment which, in addition to the force doubling mechanism 8 provided by the lever 81, incorporates a force doubling mechanism 80 comprising speed reduction gears 84 and 85. With reference to the illustrated embodiment, a handle stem 61 provided with a handle 60 is supported by a bearing sleeve 36 projecting from the center of the front wall 31 of the fixed support 3. The drive gear 84 is mounted on the stem end extending through the front wall 31 inwardly thereof. On the other hand, a screw shaft 86 screwed into a threaded sleeve 37 projecting from a side portion of the front wall 31 extends through the front wall 31 inwardly thereof and carries the driven gear 85 diametrically larger than the drive gear 84 and meshing with the gear 84. Consequently the torque of the handle 60 is increased in accordance with the gear ratio between the gears 84 and 85, transmitted to the screw shaft 86 and then delivered to the movable support 4 by way of the force doubling mechanism 8 including the lever 81. The driven gear 85 is attached to the screw shaft 86 by a pin 87 passed through a slot 88, which permits the reciprocal movement of the screw shaft 86.

Figure 7:
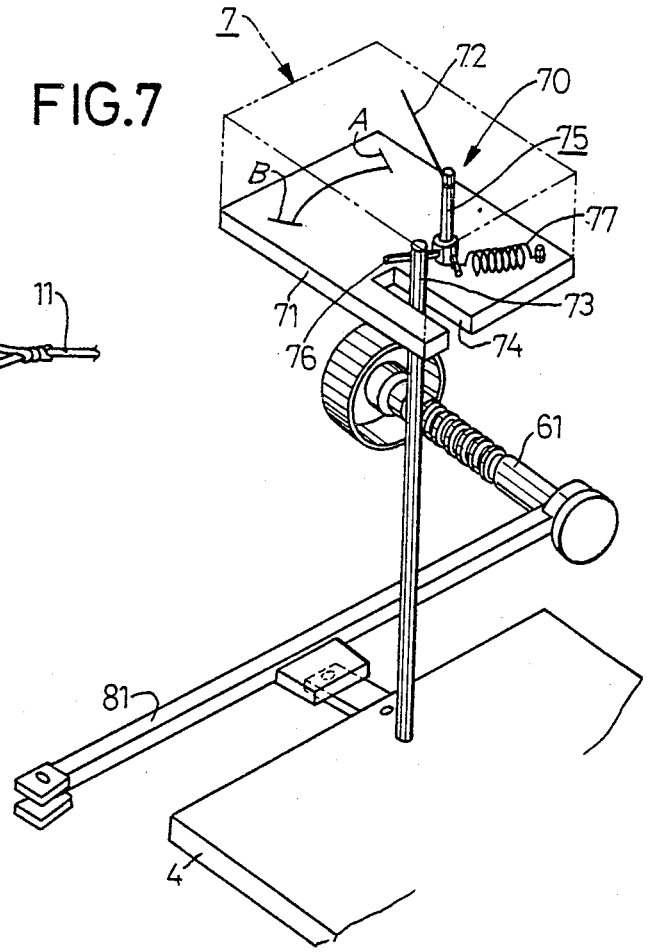
FIG. 7 is a view illustrating the construction of an indicating assembly.

The device of this invention is provided with an assembly 7 for indicating on a scale the distance of movement of the movable support 4, namely, the degree of tension of the strings 11. While the indicating assembly 7 can be embodied variously, the present embodiment comprises an indication panel 71 mounted on the head base and having engraved thereon a mark A for indicating a proper tensioned state of the strings 11 and a mark B for indicating a suitable loosened state of the strings 11, as seen in FIG. 7. The indicating assembly 7 has an indicator 70 which is shiftable with the travel of the movable support 4. The indicator 70 is provided with an operating rod 73 extending upward from the movable support 4. The rod 73 has an upper end projecting upward beyond the base 2 and reciprocally movably engaged in a guide groove 74 formed in an edge of the indication panel 71. On the other hand, a pin 75 having a pointer 72 is rotatably supported on the indication panel 71. A transmitting member 76 extends from the pin 75 to convert the reciprocating movement of the operating rod 73 to a turning motion and deflect the pointer 72.

The pin 75 is provided with a spring 77, which biases the transmitting member 76 toward the operating rod 73 at all times.

Figure 13:
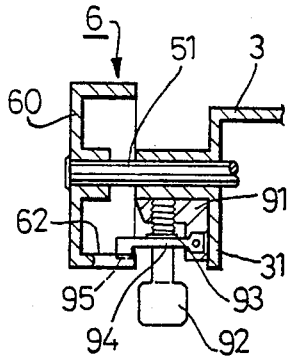
FIG. 13 is a view in section showing a holding assembly incorporated in a head.

FIG. 13 shows restraining means provided for the reciprocating assembly 6 for preventing the movable support 4 from being retracted toward the neck 13 by the tension of the strings 11.

According to the illustrated embodiment, the handle 60 of the reciprocating assembly 6 is equipped with the restraining means for preventing the retraction. However various other arrangements are usable, including means for locking the movable support 4 directly to the fixed support 3. The illustrated embodiment includes an L-shaped attaching member 91 secured to the outer face of the front wall 31 of the fixed support 3 and disposed immediately below the handle stem 51. A screw pin 93 having a knob 92 is screwed into the attaching member 91, while a pressing member 94 is pivoted to the member 91. The screw pin 93, when turned, forces the pressing member 94 downward and presses a forward end pressing portion 95 of the member 94 against the inner face of a flange 62 of the handle 60 to prevent the handle 60 from turning reversely. The support 4 can be restrained from retraction with greatly improved effectiveness if the inner face of the flange 62 is formed with a large number of incisions or the like to produce increased friction between the flange 62 and the pressing member 94.

Although the present invention has been described above as embodied for a folk guitar, the construction described above is useful for classic guitars alike.

Figure 8:
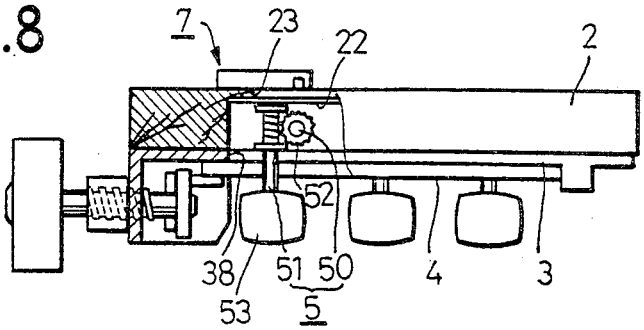
FIG. 8 is a front view partly broken away and showing the construction of a head embodying the invention for a classic guitar.
Figure 9:
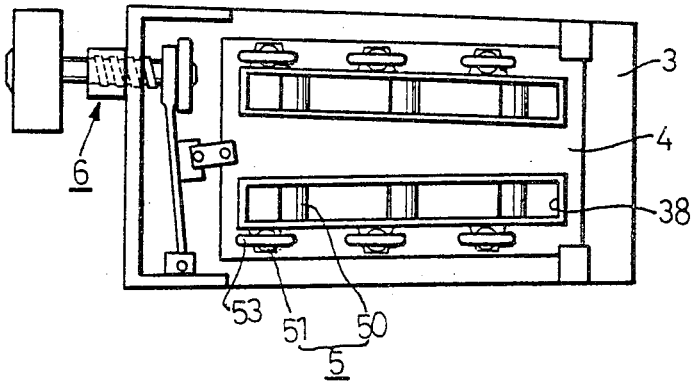
FIG. 9 is a view showing the construction of the head as it is seen from therebelow.
Figure 10:
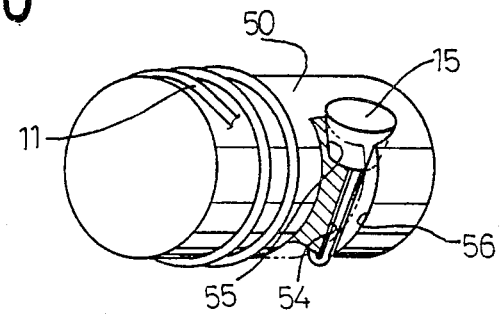
FIG. 10 is a perspective view partly broken away and showing a winding pin with a string held thereto.

FIG. 8 shows an embodiment of the invention adapted for a classic guitar. A head base 2 integral with a neck 13 has a cavity 22 dimensioned to accommodate winding assemblies 5 for all strings 11 and formed in the under side of the base. The cavity 22 is in communication with two coextensive elongated apertures 23 and 23 formed in its bottom wall. A fixed support 3 is also formed with elongated apertures 38 and 38 in corresponding relation to the apertures 24. The string winding assemblies 5 are mounted on a movable plate 4 and positioned within the cavity 22. String winding pins 50 are disposed below the apertures 23 and supported horizontally. Pegs 51 coupled to the pins by worm gears 52 extend downward and have knobs 53 below the movable plate 4. As shown in FIG. 10, the winding pin 50 has a string insertion bore 54 extending diametrically therethrough. The insertion bore 54 has a holding portion 55 formed by enlarging one open end thereof and a string engaging groove 56 formed by cutting a peripheral portion of the pin 50 along a diametrical line and communicating with the insertion bore 54. An end portion of the string 11 is placed into the insertion bore 54 through the groove 56 with the string end attached to a holder 15, and the holder 15 is engaged in the holding portion 55. The end portion of the string 11 is thus held to the winding pin 50 and wound around the pin 50.

A description will not be given of a reciprocating assembly 6, an indicating assembly 7, etc. since they have the same construction as those used for the folk guitar described.

Figure 11:
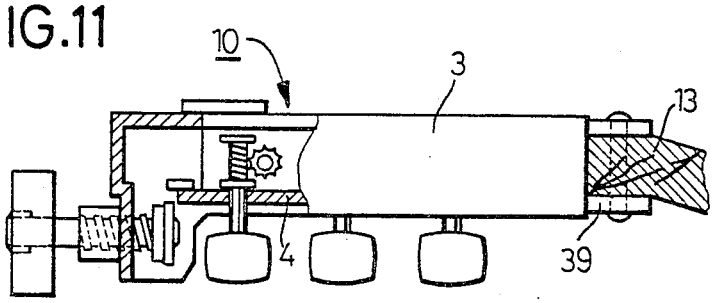
FIG. 11 is a front view partly broken away and showing a head embodying the invention for a folk guitar.

FIG. 11 shows an embodiment in which a fixed support 3 is connected directly to the forward end of a neck 13 to provide a head 10.

The fixed support 3 of the illustrated embodiment is in the form of a case having a bottom opening. A movable plate 4 carrying string winding assemblies 5 is disposed in and reciprocally supported by the case. The support 3 has at its rear end connecting flanges 39 fitting to the forward end of the neck 13. This embodiment is advantageous over the foregoing embodiment having a base in that it assures savings in material and does not require labor for making the base.

Industrial Applicability

The tuning device of this invention is used in the following manner.

First, the handle 60 of the reciprocating assembly 6 is turned to advance the movable support 4 toward the forward end and then stopped when the pointer 72 of the indicating assembly 7 has pointed to the mark A indicating the proper tension. The movable support 4 is locked to its stopped position by the locking means 9. Subsequently the knobs 53 of the winding assemblies 5 are turned to tension and accurately tune the strings 11 with use of a pitch pipe or the like.

After playing, the movable support 4 is released from the restraining means 9, and the handle 60 is turned in a direction opposite to the above to retract the movable support 4 and is then stopped when the pointer 72 of the indicating assembly 7 has pointed to the mark B showing a suitable loosened state. With the strings 11 uniformly loosened, the stringed instrument can be stored without any likelihood of a break or elongation of the strings, or damage or deformation of the string holding portions.

When the instrument is to be used again, the movable support 4 is returned by turning the handle 60 to bring the pointer 70 of the indicating assembly 7 to the position of the mark A showing the proper tension, whereby all the strings 11 can be tensioned to the same state as previously in which they are accurately tuned, without any necessity of readjusting each of the strings 11.

When the indicating assembly 7 is not provided, the instrument is usable with substantially the same advantages as above by counting the number of turns of the handle 60.

I claim:

1. A tuning device for a stringed musical instrument comprising a movable support (4) supported by the head (10) of the instrument and reciprocally movable along strings (11), string winding assemblies (5) mounted on the movable support (4) and each having a string winding pin (50) for winding an end of the string thereon, and a reciprocating assembly (6) provided between the head (10) and the movable support (4) for forcibly moving the movable support (4), the string winding pin (50) being formed with a string insertion bore (54), a holding portion (55) provided by an enlarged opening of the insertion bore and a string engaging groove (56) formed in the surface of the pin and communicating with the insertion bore (54), the string end having attached thereto a holder (15) engageable with the holding portion (55).

2. A tuning device for a stringed musical instrument as defined in claim 1 wherein the holder (15) is tapered toward its one end connected to the string.

3. A tuning device for stringed musical instrument as defined in claim 1, wherein the holder (15) has closeable cutout grooves (16) in its periphery and the string end engages in the cutout grooves (16), whereby the groove openings are closed and the holder is thereby attached to the string (11).

4. A tuning device for a stringed musical instrument as defined in claim 1 wherein the holder (15) has the string end embedded therein and is thereby connected to the string (11).

5. A tuning device for a stringed musical instrument as defined in claim 1 and further including an indicating assembly provided on said head of said musical instrument for indicating the amount of movement of said movable support on a scale, said indicating assembly including an indicator which is mounted to shift with the travel of said movable support.

* * * * *